US005078614A

United States Patent [19]

Shotey

[11] Patent Number: 5,078,614

[45] Date of Patent: Jan. 7, 1992

[54] SLIDING COVER AND SHROUD FOR ELECTRICAL OUTLETS

[76] Inventor: Michael J. Shotey, 7733 E. Cypress, Scottsdale, Ariz. 85257

[21] Appl. No.: 596,777

[22] Filed: Oct. 12, 1990

[51] Int. Cl.[5] ..... H01R 13/44

[52] U.S. Cl. ..... 439/136; 174/67; 439/142; 439/147

[58] Field of Search ..... 174/66, 67; 439/135, 439/136, 142, 147

[56] References Cited

U.S. PATENT DOCUMENTS 2,916,733 12/1959 Hirsch ..... 174/67

4,643,502 2/1987 Arnold ..... 174/67

4,857,004 8/1989 Poirier ..... 439/140

*Primary Examiner*—Paula A. Bradley

*Attorney, Agent, or Firm*—Cahill, Sutton & Thomas

[57] ABSTRACT

A detachably attachable cover slidingly mates with a face plate surrounding an electrical socket to protect the electrical socket against incursion of water and contaminants. In a variant cover, a plugged in electrical plug is also protected. A flexible shroud is attachable to a continuous wall encircling the electrical socket to receive and shield both the electrical socket and a plugged in electrical plug.

2 Claims, 2 Drawing Sheets

SLIDING COVER AND SHROUD FOR ELECTRICAL OUTLETS

BACKGROUND OF THE INVENTION

1. Field of the Invention

The present invention relates to electrical outlets, and more particularly, to electrical outlet covers accommodating plugged in electrical plugs.

2. Description of the Prior Art

Electrical outlets for both home and commercial use are often located outdoors to provide electrical power to electrically operated appliances, tools and other devices regularly or intermittently used outdoors. Unless the outlets are protected by an awning, overhang or other weather protecting element, there exists a substantial possibility that an electrical hazard will be created under certain weather conditions or as a result of various activities in proximity to the electrical outlet. Moreover, such electrical outlets, weather indoor or outdoor, are subject to the presence of various liquid and solid contaminants which may affect operability or compromise safety.

Various covers have been devised for covering or sealing an electrical outlet during nonuse. Electrical outlets, whether for use indoors or outdoors, are generally mounted flush with an adjacent wall surface. Such mounting necessitates that electrical plugs plugged therein extend outwardly from the surrounding wall surface. These plugs may be partially dislodged as a result of inadvertent contact by persons or objects. A partial dislodgement generally exposes the prongs of the electrical plug, which exposure creates an electrical hazard. In an outdoor environment, exposed prongs of plugs plugged into a conventional electrical outlet may create an electrical hazard as a result of rain or particulate matter in contact with an exposed electrical prong.

A cover for enclosing electrical plugs plugged into an electrical outlet is disclosed in U.S. Pat. No. 4,803,307. Such a cover provides adequate shielding of an electrical outlet and any electrical plug plugged therein to. The cover is hinged along one edge to the underlying support structure. Since the cover extends from the wall surface it may be bumped or otherwise struck. The impact forces imposed may damage or break the hinge at the single edge of hinge attachment.

SUMMARY OF THE INVENTION

A face plate for an electrical outlet includes a continuous wall surrounding the electrical outlet and a pair of opposed vertical channels for slidingly receiving and retaining the edges of a cover having an open bottom side. The cover encloses the continuous wall and shields the electrical outlet from the top, the opposed sides and the front during nonuse of the electrical outlet. In a variant, the depth of the cover is sufficient to accommodate a plugged in electrical plug and its cord extending downwardly through the open side of the cover. The continuous wall extends from the face plate to removably support a flexible shroud. The shroud encloses a plugged in electrical plug and has a closable open end for accommodating insertion and removal of the electrical plug and for tightly encircling the electrical cord extending therefrom. During nonuse of the shroud, it is packed within the space defined by the continuous wall. The shroud may be used after removal of the cover or in conjunction with the cover to protect the electrical outlet and plugged in plug.

It is therefore a primary object of the present invention to provide a slidable cover for protecting an electrical outlet and a shroud for shielding an electrical plug plugged into the electrical outlet.

Another object of the present invention is to provide a flexible shroud for shielding an electrical outlet and any electrical plug plugged therein to.

Still another object of the present invention is to provide a slidable cover for shielding an electrical outlet whether or not an electrical plug is plugged into the electrical outlet.

Yet another object of the present invention is to provide storage and support for a flexible shroud used to shield an electrical plug plugged into an electrical outlet.

A further object of the present invention is to provide a retrofittable cover and shroud for an electrical outlet.

A still further object of the present invention is to provide an inexpensive flexible shroud for enclosing an electrical outlet and any electrical plug plugged therein to.

A yet further object of the present invention is to provide a method for providing weather tight shielding for electrical plugs plugged into an electrical outlet.

These and other objects of the present invention will become apparent to those skilled in the art as the description thereof proceeds.

BRIEF DESCRIPTION OF THE DRAWINGS

The present invention will be described with greater clarity and specificity with reference to the following drawings, in which.

DESCRIPTION OF THE PREFERRED EMBODIMENT

Figure 1:
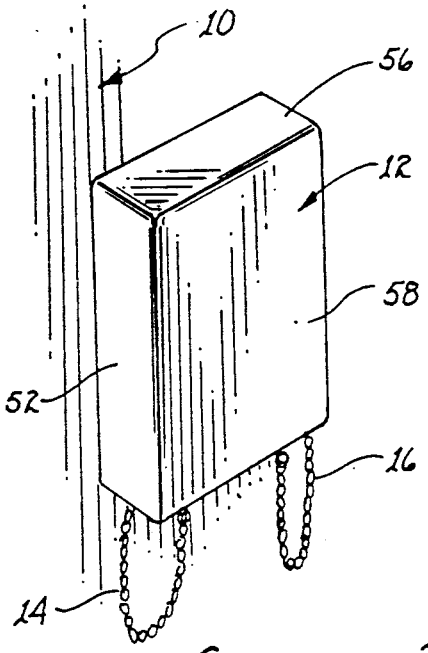
FIG. 1 is an isometric view of the present invention.

Referring to FIG. 1 there is illustrated a wall surface 10 for supporting a conventional electrical outlet having one or more sockets. It is anticipated that the wall surface is an exterior surface subject to the elements, such as rain. Since water, no mater the source, creates an electrical hazard if in proximity to or contact with an electrical outlet, it is necessary to shield such electrical outlet from the water. Moreover, it is just as necessary to shield any electrical plug plugged into one of the sockets of the electrical outlet. A cover 12, in the form of a box having an open bottom side, lateral sides, top side and a front side, provides protection against the elements. A pair of chains 14, 16, which may be cords or the like, maintain cover 12 attached to the electrical outlet and prevent detachment; other devices may be used to prevent detachment.

Figure 2:
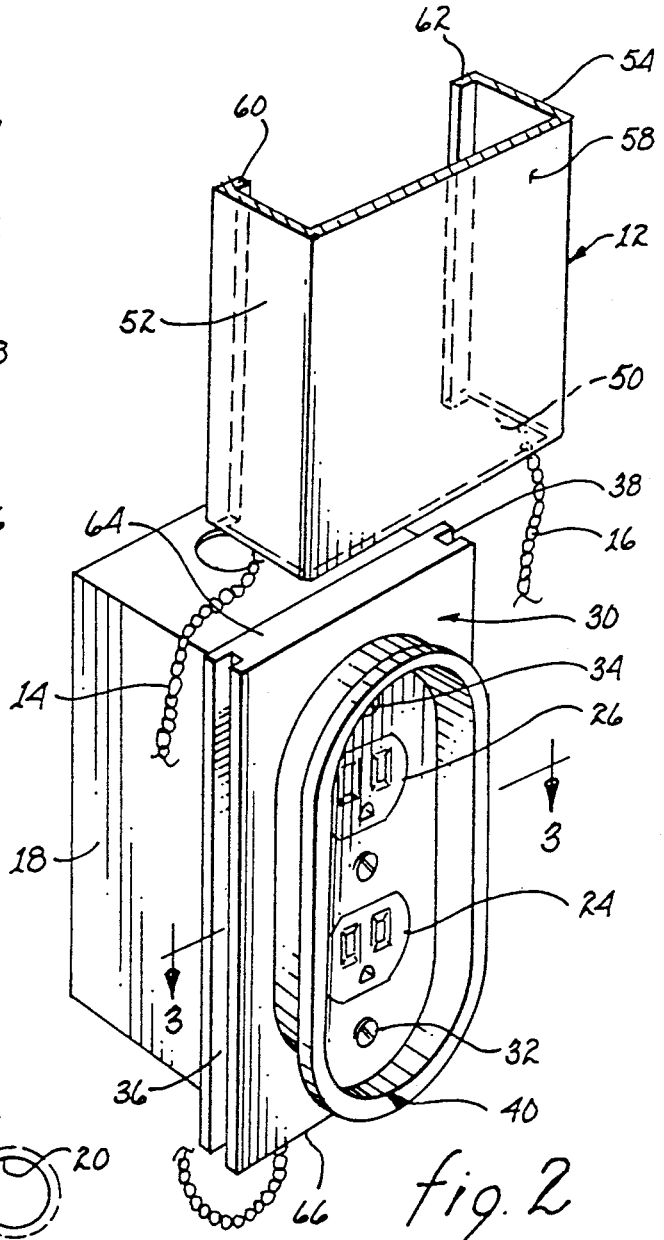
FIG. 2 is an isometric view illustrating components of the electrical outlet and cover.
Figure 3:
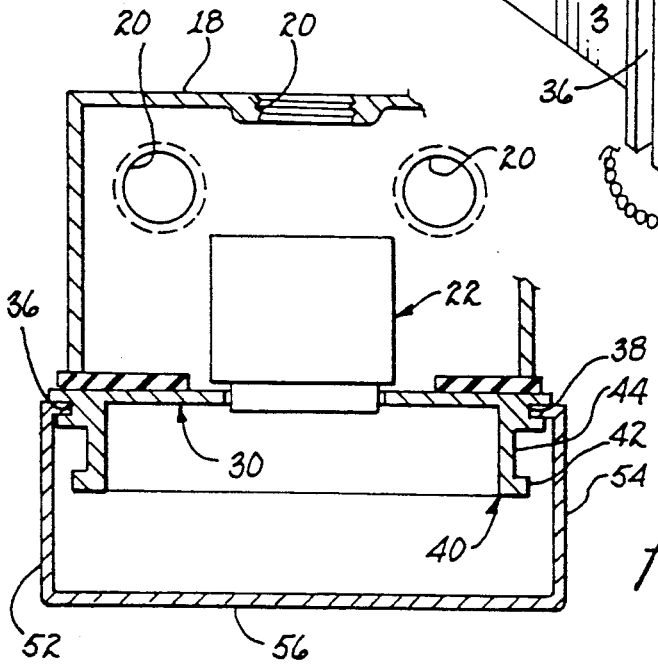
FIG. 3 is a partial cross sectional view taken along lines 3—3, as shown in FIG. 2.

Further details attendant cover 12 and the protected electrical outlet will be described with joint reference to FIGS. 1, 2 and 3. A conventional electrical box 18 is attached to a wall stud in the conventional manner. The electrical box includes a plurality of apertures 20 for accommodating ingress and egress of electrical conductors. A conventional electrical outlet 22 is secured in the normal manner to electrical box 18. The electrical outlet may include two sockets 24, 26 for receiving electrical plugs. A face plate 30 is attached to electrical box 18 by machine screws 32, 34, or the like. The face plate includes laterally disposed opposed grooves 36, 38. A continuous wall 40 extends from face plate 30 in encircling relationship with sockets 24, 26; the continuous wall may define an oval, as illustrated. An outwardly extending lip 42 is disposed outwardly at the terminal edge of the continuous wall.

Cover 12 has an open bottom defining an opening 50, sidewalls 52, 54, a top wall 56 and a front wall 58. Terminal edges of side walls 52, 54 include inwardly extending tongues 60, 62 for sliding engagement with grooves 36, 38, respectively. Top edge 64 of face plate 30 interferingly engages top wall 56 to limit downward sliding movement of cover 12 with respect to the face plate. Chain 14 may be attached to the lower edge of side wall 52 as illustrated and it may extend to bottom edge 66 of the face plate for attachment thereto. Similarly, chain 16 may be attached to the lower edge of side wall 54 and it may extend to bottom edge 66 for attachment thereto. Thereby, upward translation of cover 12 with respect to face plate 30 will result in disengagement of the cover with the face plate but the chains will maintain the cover in proximity with the electrical outlet; other means may be used to prevent disengagement. As particularly illustrated in FIG. 3, the width of the sidewalls and the top wall accommodates clearance between continuous wall 40 and front wall 58. In the embodiment illustrated in FIGS. 1, 2 and 3, cover 12 serves primarily to protect the electrical outlet during periods of nonuse.

Figure 6:
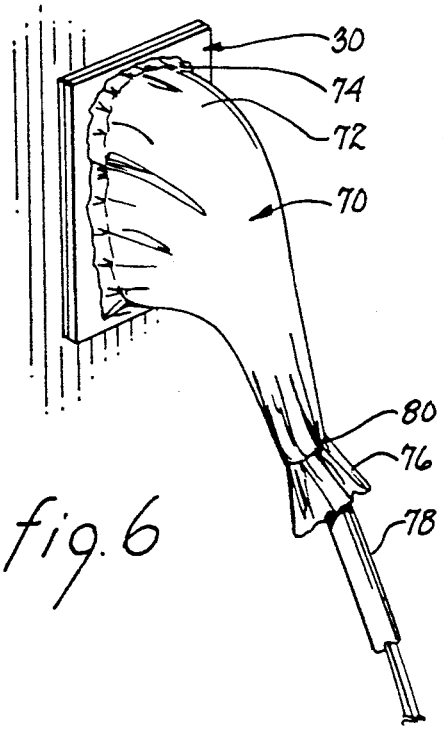
FIG. 6 illustrates a flexible shroud in use.
Figure 7:
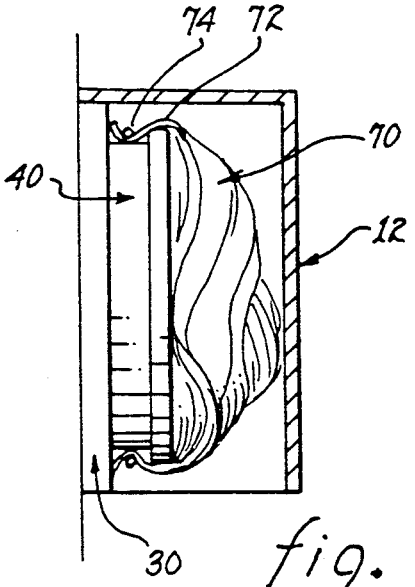
FIG. 7 illustrates storage of the flexible shroud.

To protect the electrical outlet during periods of use, a shroud 70, shown in FIGS. 6 and 7, may be employed to protect the electrical outlet and any electrical plug or plugs plugged there into. The shroud is sheath like and of water resistant or water impermeable flexible material. End 72 of shroud 70 encircles continuous wall 40 and closure means 74 is used to draw end 72 tightly about channel 44 defined by lip 42 and face plate 30. The closure means may be a simple draw string. Alternatively, the closure means may include a strap adjustably attachable by a hook and loop structure such as that sold under the trademark Velcro. The latter provides a simple and easy to use closure means for attaching and detaching shroud 70 with continuous wall 40. An electrical plug to be plugged into one of electrical sockets 24, 26 is inserted through open end 76 of shroud 70. After the plug is plugged in, end 76 is wrapped about electrical conductor 78 extending from the electrical plug and retained in place by further closure means 80. For this purpose, a strap wrapped around end 76 and retained in place by a hook and loop attachment means, such as that sold under the trademark Velcro, is particularly useful and convenient.

Because shroud 70 restricts if not completely inhibits water flow therethrough, the enclosed electrical sockets and plugged in plug or plugs are well protected against the weather and contaminants. The flexible nature of shroud 70 will permit it to yield, instead of break, in response to lateral forces inadvertently imposed upon conductor 78 or against the shroud itself. Thus, damage to shroud 70 from normal expected and anticipated abuse is unlikely.

During nonuse of the electrical outlet, shroud 70 may be stored within the space defined by continuous wall 40, as depicted in FIG. 7. Upon attachment of cover 12 through engagement with grooves 36, 38 in face plate 30, protection for both the shroud and continuous wall 40 is provided. As discussed above, during use of shroud 70 to protect a plugged in electrical plug, cover 20 may dependingly hang from face plate 30 via chains 14, 16 although such attachment is not illustrated in FIG. 6.

Figure 4:
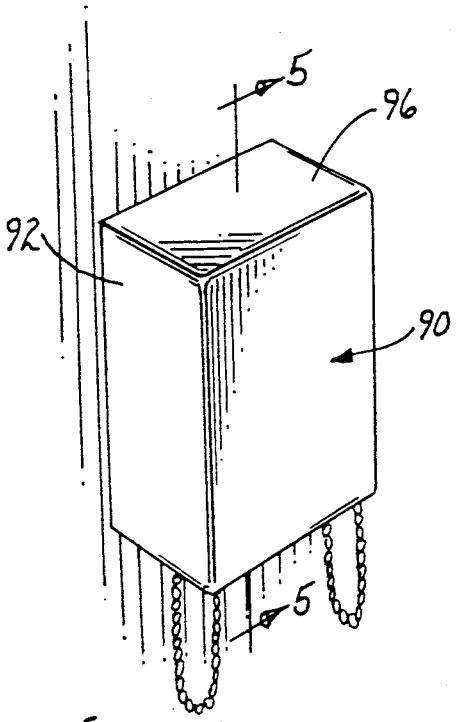
FIG. 4 illustrates a variant cover.
Figure 5:
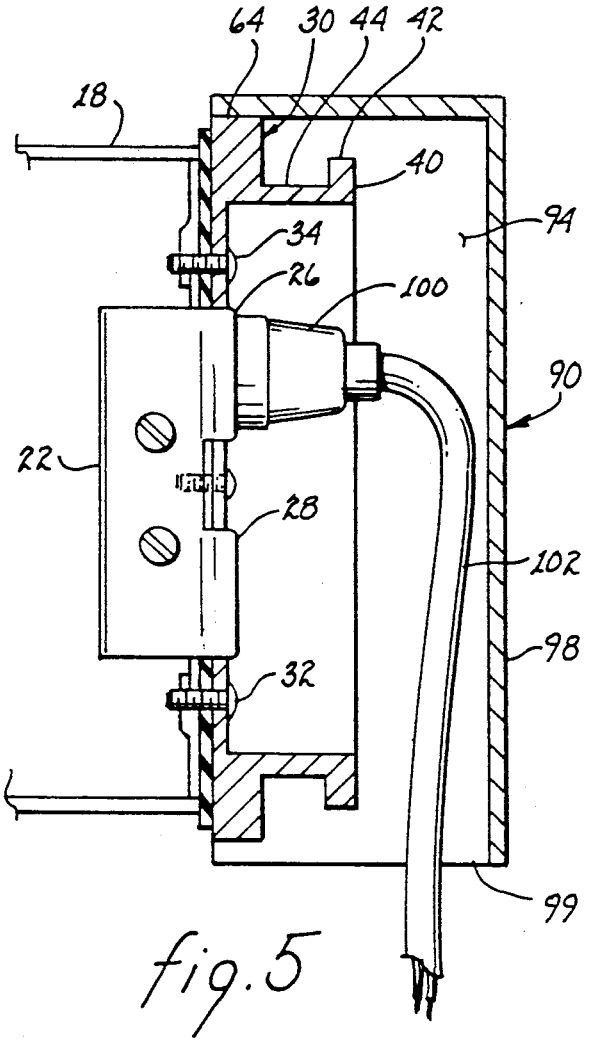
FIG. 5 is a partial cross sectional view taken along lines 5—5, as shown in FIG. 4.

Referring jointly to FIGS. 4 and 5, a variant 90 of cover 12 is illustrated. In this variant, side walls 92, 94 and top wall 96 are of sufficient width to accommodate plugged in plug 100 and its depending electrical conductor 102. In operation, cover 90 would be slid upwardly, as described above with respect to cover 12 to provide access to one of plugs 26, 28. Plug 100 would be engaged with one of the sockets; a second plug may be engaged with the other socket. Upon subsequent sliding engagement of the cover with the face plate and seating the cover as illustrated in FIG. 5 against top edge 64 of the face plate, front wall 98 will clear the plugged in plug(s) and accommodate a reasonable radius downward bend of the electrical conductors. The electrical conductor exits from within cover 90 through opening 99 at the bottom of the cover.

In addition to variant cover 90, a shroud 70 may be used to further enclose the plugged in plug(s) through attachment of the shroud to continuous wall 40 in the manner described above. Alternatively, the shroud may be used when variant cover 90 is not to be replaced during a period of time while a plug is plugged in.

Withdrawal of a plugged in plug 100 is accomplished by upward sliding movement of variant cover 90 to provide access to the plug and thereafter unplugging it. If shroud 70 is also used, its end 76, if closed, would be opened to permit moving end 76 toward end 74 and provide manual access to the plug. Upon unplugging, the plug would be withdrawn from within the shroud. Subsequent storage of the shroud within continuous wall 40 and replacement of variant cover 90 will maintain the electrical outlet in a weather protected state.

Face plate 30 is similar to a conventional electrical outlet face plate. Accordingly, any existing electrical outlet can be retrofitted with the present invention by replacing the existing face plate with face plate 30.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. Apparatus for protecting at least one electrical socket and each electrical plug plugged thereinto, said apparatus comprising in combination:

a) a face plate surrounding the electrical sockets, said face plate including a top edge extending there across and opposed side edges;

b) a box having an open bottom side, a pair of opposed side walls, a top wall and a front wall for covering the electrical sockets;

c) tongue and groove means disposed intermediate said side edges of said face plate and said side walls of said box for permitting downward sliding of said box with respect to said face plate to cover the electrical outlets and upward sliding of said box with respect to said face plate to uncover the electrical outlets;

d) said sidewalls and said top wall being of sufficient width to accommodate enclosure of electrical plugs plugged into the electrical sockets upon downward sliding of said box, said top wall also being of sufficient width to extend across said top edge of said face plate and rest upon said top edge upon full downward sliding of said box; and e) means for retaining said box attached to said face plate.

2. The apparatus as set forth in claim 1 wherein said retaining means includes cord means interconnecting said box with said face plate.

* * * * *